US009620865B2

(12) United States Patent
Nagaishi et al.

(10) Patent No.: US 9,620,865 B2
(45) Date of Patent: Apr. 11, 2017

(54) ANTENNA BEAM SCAN MODULE, AND COMMUNICATION APPARATUS USING THE SAME

(71) Applicant: HITACHI CHEMICAL COMPANY, LTD., Tokyo (JP)

(72) Inventors: Hideyuki Nagaishi, Hachioji (JP); Masayuki Miyazaki, Tokyo (JP); Yuichi Shimayama, Shimotsuke (JP)

(73) Assignee: Hitachi Chemical Company, Ltd., Tokyo (JP)

( * ) Notice: Subject to any disclaimer, the term of this patent is extended or adjusted under 35 U.S.C. 154(b) by 1096 days.

(21) Appl. No.: 13/765,119

(22) Filed: Feb. 12, 2013

(65) Prior Publication Data

US 2013/0214974 A1 Aug. 22, 2013

(30) Foreign Application Priority Data

Feb. 20, 2012 (JP) ..... 2012-034373

(51) Int. Cl.

| | |
|---|---|
| ***H01Q 21/00*** | (2006.01) |
| ***H01Q 3/24*** | (2006.01) |
| ***H01Q 3/26*** | (2006.01) |
| ***H01Q 3/40*** | (2006.01) |
| ***H01Q 3/46*** | (2006.01) |

(52) U.S. Cl.

CPC ..... *H01Q 21/0031* (2013.01); *H01Q 3/24* (2013.01); *H01Q 3/2658* (2013.01); *H01Q 3/40* (2013.01); *H01Q 3/46* (2013.01)

(58) Field of Classification Search

CPC .... H01Q 21/0031; H01Q 3/24; H01Q 3/2658; H01Q 3/40; H01Q 3/45

See application file for complete search history.

(56) References Cited

U.S. PATENT DOCUMENTS 4,042,931 A * 8/1977 Gustafsson ..... G01S 3/22 342/427
2010/0073260 A1 3/2010 Fujita
2012/0257653 A1* 10/2012 Nagaishi ..... H01Q 3/2682 375/219

FOREIGN PATENT DOCUMENTS

JP 2003-152422 A 5/2003
JP 2006-287501 A 10/2006
JP 2010-074781 A 4/2010

OTHER PUBLICATIONS

English Translation of JP 2003-152422 A.*
English Translation of JP 2006-287501 A.*
English Translation of JP2010-074781 A.*

* cited by examiner

*Primary Examiner* — Bernarr Gregory
*Assistant Examiner* — Fred H Mull
(74) *Attorney, Agent, or Firm* — Mattingly & Malur, PC

(57) ABSTRACT

Signals are maintained to be in phase at beam input ports of a Rotman lens antenna, and thus scanning at non-step antenna beam angles can be realized without increasing the number of input beams. The present invention provides an antenna beam scan module including: a Rotman lens that has plural beam ports and plural antenna ports; plural antenna elements; relative phase detectors that detect a relative phase difference between the signals input to the adjacent beam ports; phase shifters that offset the relative phase difference between the signals supplied to the adjacent beam ports on the basis of the relative phase difference detected by the relative phase detectors; and switches that select routes of the signals supplied to the beam ports through variable amplifiers, wherein the phase shifters are arranged on alternate routes through which the signals are supplied to the plural beam ports.

14 Claims, 10 Drawing Sheets

ANTENNA BEAM SCAN MODULE, AND COMMUNICATION APPARATUS USING THE SAME

CLAIM OF PRIORITY

The present application claims priority from Japanese patent application JP2012-034373 filed on Feb. 20, 2012, the content of which is hereby incorporated by reference into this application.

BACKGROUND OF THE INVENTION

1. Field of the Invention

The present invention relates to an antenna beam scan module in an antenna device that combines and distributes phases using a Rotman lens.

2. Description of the Related Art

A phased array antenna has been known as a technique of selectively transmitting and receiving electromagnetic waves in a specific direction by scanning a beam. The phased array antenna composed of plural antenna elements can scan a beam by actively changing an electromagnetic phase plane from each antenna element. As a method of realizing the same, a variable phase shifter is provided for each antenna element to be independently controlled so that a desired beam angle is formed. Further, a phased array antenna without variable phase shifters can be realized by connection to each antenna element through a Rotman lens that can combine and distribute electromagnetic waves.

Japanese Patent Application Laid-Open Publication No. 2003-152422 is a related art of the technical field. This document describes "adder circuits are provided to add outputs from two beam ports 20-*m* and 20-(*m*+1) of a Rotman lens. A directivity angle between those of beams corresponding to two beam ports can be obtained by addition. Accordingly, the directivity angles of discrete beams can be interpolated" (see Abstract).

Further, Japanese Patent Application Laid-Open Publication No. 2010-074781 describes "a variable amplifier is provided at each of beam ports (transmission ports) BP1 and BP2 of a Rotman lens that forms a transmission beam and each of beam ports (reception ports) BP1 and BP2 of a Rotman lens that forms a reception beam to adjust the gain, so that the directivity of the transmission beam or the reception beam is adjusted. Accordingly, the transmission beam or the reception beam that is directed to an arbitrary direction other than a specified direction corresponding to each beam port can be realized with a simple configuration without using high-frequency switches" (see Abstract).

Further, Japanese Patent Application Laid-Open Publication No. 2006-287501 describes "the invention includes a coupler that extracts a transmission signal supplied to an antenna element through an RF circuit, a DFT (Discrete Fourier Transform) that converts the extracted signal to a signal of a frequency domain, an IDFT (Inverse Discrete Fourier Transform) that converts a signal output from a multiplier into a signal of a time domain, a delay unit that adds a delay temporally combined to the signal extracted through the RF circuit to a signal output from the IDFT, a DFT that converts the signal with the delay added into a signal of a frequency domain, a level/phase detector that detects a magnitude difference and a phase difference by comparing output signals from plural DFTs, a level/phase controller that offsets the magnitude and phase of a transmission signal of each antenna element in accordance with the detected result, and a multiplier" (see Abstract).

SUMMARY OF THE INVENTION

In the conventional phased array antenna using a Rotman lens, electromagnetic waves are transmitted and received only by a communication device in a desired direction from narrow-angle antenna beams formed by plural antenna elements, so that the multipath from obstacles can be avoided as shown in Japanese Patent Application Laid-Open Publication No. 2003-152422. Further, in the case where a target communication device exists in the middle between peak angles of the beams generated by the Rotman lens, signals of adjacent input ports of the Rotman lens are processed using accumulators or multipliers, so that the antenna gain in a desired direction can be realized and the angles of the antenna beams can be made narrower. The phased array antenna using a Rotman lens can generate an intermediate beam by combining electric power, and thus the number of beams can be increased without increasing the number of input ports of the Rotman lens. However, generation of the intermediate beam using the accumulators or the like is a technique that can be adapted only to a receiver as shown in Japanese Patent Application Laid-Open Publication No. 2003-152422.

Meanwhile, the phased array antenna is configured using a Rotman lens in Japanese Patent Application Laid-Open Publication No. 2010-074781. The ratio of electric power for two input ports is adjusted by using variable amplifiers, so that beams can be formed at infinite step angles in an intermediate range of the beams obtained from the input ports.

According to Japanese Patent Application Laid-Open Publication No. 2003-152422 and Japanese Patent Application Laid-Open Publication No. 2010-074781, the directivity can be directed to the intermediate direction of the beams corresponding to the input ports by distributing and supplying electric power to adjacent input ports of the Rotman lens even in a transmitter. However, in order to overlap the beam peaks with each other to be directed to the intermediate direction of the beams, it is required for radio waves from the antenna to be in phase at the position in the intermediate direction. Accordingly, in the phased array antenna that generates the intermediate beam by spatial combination of beams irradiated from the Rotman lens antenna of the transmitter using electric power supplied from each input port, it is necessary to control the phases input to the input ports to monitor the state of the radio waves emitted from the antenna.

In order to control the beam using the phased array antenna, it is necessary to control the magnitudes and phases of transmission signals emitted from the antenna elements. However, the relative magnitude ratios and the phase differences of the transmission signals after being amplified by the variable amplifiers cannot be compared by the structure described in Japanese Patent Application Laid-Open Publication No. 2010-074781. Thus, it is uncertain whether or not transmission signals have been correctly transmitted by a beam controller. Manufacturing errors of variable amplifiers and temperature changes are stored as data in a map storage unit, and the beam controller can adjust using the data. However, the map data generated at the time of an inspection of the antenna module is not adapted for aging degradation of the variable amplifiers, and thus the map data needs to be updated. Further, the variable amplifiers in the antenna module have manufacturing errors. Thus, it is necessary for each antenna module to obtain the map data, and costs incurred for an inspection of manufacturing errors and temperature characteristics are disadvantageously increased.

The propagation characteristics as well as the phase characteristics of the variable amplifiers are changed depending on the amplification degree. In the case where adjacent variable amplifiers are controlled using different amplification degrees, the in-phase properties of each transmission signal input to the input ports of the Rotman lens are not maintained. Further, if reflective characteristics are changed due to changes in propagation characteristics of the variable amplifiers because distributors are arranged before the variable amplifiers, the distribution ratio of the distributors and the phase characteristics are changed. In the case where the number of input ports of the Rotman lens antenna is two, a shipping inspection is relatively simple. However, in the case where the number of input ports is three or larger, sufficient isolation is necessary in propagation characteristics between output ports of directional couplers and distributors so as not to have an impact from unused variable amplifiers on the distributors in the magnitude control. Accordingly, a phase offset system for transmission signals is essential in the scanning control of the intermediate beams that are generated by supplying transmission signals to plural input ports of the Rotman lens antenna.

Japanese Patent Application Laid-Open Publication No. 2006-287501 describes a beam control technique in which the magnitude and phase of a transmission signal of an array antenna composed of plural antenna elements are operated to control emittance patterns. The transmission characteristics of RF circuits connected to the antenna elements are affected by manufacturing errors and temporal temperature changes, and the RF circuits are independently fluctuated, thus affecting the beam control technique. As a method of adjusting the transmission characteristics of the RF circuits, transmission signals supplied to the antenna elements are extracted to be compared with those input to the RF circuits, so that the magnitude difference and phase difference are detected. In accordance with the detection result by a detector, the relative level difference and phase difference between signal systems of the antenna elements are obtained, an offset coefficient is calculated to offset the relative level difference and phase difference between signals of the antenna elements in a predetermined range, and transmission signals are offset by a multiplier in accordance with the offset coefficient. As a result, the magnitudes and phases of the transmission signals emitted from the antenna elements are offset by a multiplier of a propagation characteristic offset device, so that the propagation characteristics of the RF circuits are adjusted to be the same. In the configuration of Japanese Patent Application Laid-Open Publication No. 2006-287501 in which the offset coefficient is obtained to maintain the identity of the propagation characteristics between the signal systems of the RF circuits if the magnitudes and phases are controlled by the RF circuits (variable amplifiers) (for the Rotman lens antenna), the identity of the RF circuits is collapsed and consistency of the relative level difference and phase difference between the signal systems of the antenna elements cannot be maintained, resulting in generation of wrong offset signals. Accordingly, the propagation characteristic adjusting device cannot be adapted to generation of non-step intermediate beams for the Rotman lens antenna, and the beam scanning becomes difficult. Further, the magnitude and phase differences are not extracted by directly comparing the transmission signals in Japanese Patent Application Laid-Open Publication No. 2006-287501. In the case where the amplification degrees of the RF circuits are fluctuated on the temporal axis, if a time interval until the offset coefficient of the adjusting device is calculated becomes longer, errors caused by the fluctuations are overlapped with the offset coefficient. The amount of phase rotation of electromagnetic waves with a short wavelength such as millimeter waves is large per unit time, and thus errors caused by the fluctuations on the temporal axis are increased and offset data becomes insufficient in the extraction of the propagation characteristic phase difference of the RF circuits between the signal systems.

In order to address the above-described problems, an object of the present invention is to provide an antenna beam scan module in which signals are maintained to be in phase at beam input ports of a Rotman lens antenna, and thus scanning at non-step antenna beam angles can be realized without increasing the number of input beams.

In order to address the above-described problems, for example, the configurations described in claims are employed.

Although the present application includes plural aspects to address the above-described problems, the following is one example. The present invention provides an antenna beam scan module including: a Rotman lens that has plural beam ports and plural antenna ports and distributes and combines electric power of signals input and output to the antenna ports; plural antenna elements that input and output radio waves to the antenna ports; variable amplifiers that modulate the magnitudes of the signals input to the beam ports; relative phase detectors that detect a relative phase difference between the signals input to the adjacent beam ports; phase shifters that offset the relative phase difference between the signals supplied to the adjacent beam ports on the basis of the relative phase difference detected by the relative phase detectors; and switches that select routes of the signals supplied to the beam ports through the variable amplifiers, wherein the phase shifters are arranged on alternate routes through which the signals are supplied to the plural beam ports.

Further, the following is another example. The present invention provides an antenna beam scan module including: a Rotman lens that has plural beam ports and plural antenna ports and distributes and combines electric power of signals input and output to the antenna ports; plural antenna elements that input and output radio waves to the antenna ports; variable amplifiers that modulate the magnitudes of the signals supplied from the beam ports; relative phase detectors that are arranged before and after the variable amplifiers to detect fluctuations in relative phase difference between the adjacent signals before and after the variable amplifiers; phase shifters that offset the fluctuations in relative phase difference between the adjacent signals caused by the magnitude control on the basis of the fluctuations in relative phase difference detected by the relative phase detectors; and switches that select routes of the signals supplied from the beam ports through the variable amplifiers, wherein the phase shifters are arranged on alternate routes through which the signals are supplied from the plural beam ports.

In the antenna beam scan module configured in such a manner, one beam input port or two adjacent beam input ports that transmit transmission signals are selected by the switches among those of the Rotman lens to control the magnitudes of the transmission signals. The phase shifters that are alternately arranged have a function to offset the relative phase difference between the transmission signals fluctuated by the magnitude control. The transmission signals with the magnitudes controlled and those after passing through the phase shifters are partially extracted using the distributors or couplers to be mixed by mixers. The transmission signals are input signals distributed by the switches. Thus, the frequency components are the same, but only the phases are different from each other.

Especially, when mixing the transmission signals using I/Q mixers, two DC signals corresponding to sin Ø and cos Ø are generated due to the relative phase difference Φ between the transmission signals. The magnitude ratio of these DC signals is arc tangent and the angle of the relative phase difference can be calculated. An average phase difference offset signal on the basis of the magnitude control by the variable amplifiers is preliminarily input to each phase shifter by the beam scan controller. The relative phase difference calculated by the mixer is added to the average phase difference offset signal to be input to each phase shifter for feedback so that the relative phase difference is in phase. Accordingly, the transmission signals of the input beam ports of the Rotman lens antenna can be maintained to be in phase. The average values of the amplification degrees and the phase differences fluctuated by the magnitude control of the variable amplifiers are recorded in the beam scan controller. Even if the amplification degrees are changed due to the manufacturing deviation and temperature changes of the variable amplifiers, the phase offset can be controlled by calculating the relative phase difference with the mixer. Thus, it is not necessary to record the transmission and temperature characteristics of the variable amplifiers as data, and the inspection processes can be simplified.

The present invention can provide an antenna beam scan module in which signals can be maintained to be in phase at beam input ports of a Rotman lens antenna, and scanning at non-step antenna beam angles can be realized without increasing the number of input beams.

DETAILED DESCRIPTION OF THE INVENTION

Figure 1:
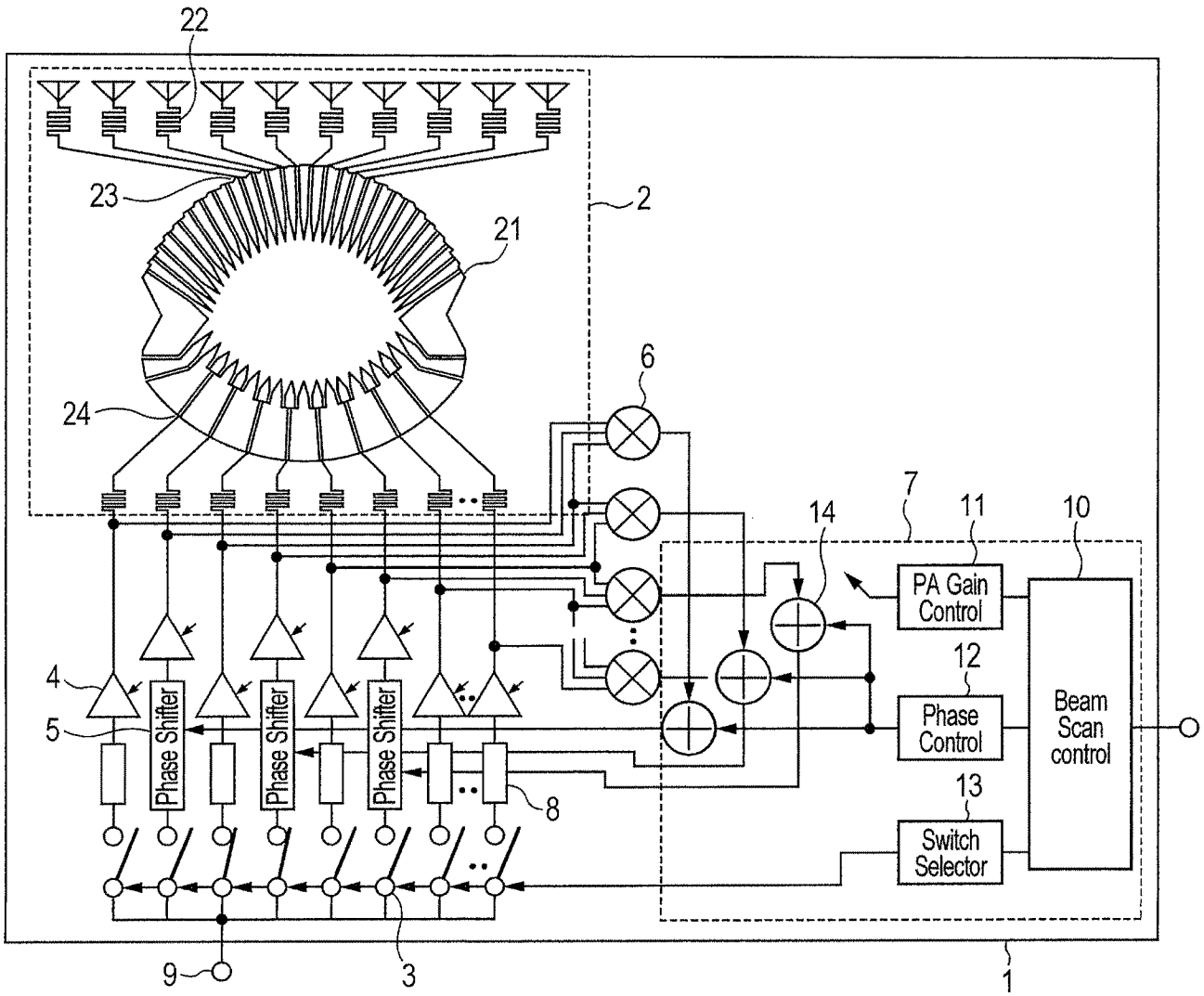
FIG. 1 is a configuration diagram of an antenna beam scan module according to a first embodiment of the present invention.

Modes for carrying out the present invention will be described in detail on the basis of the drawings. It should be noted that constitutional elements having the same functions are given the same terms and reference numerals in the all drawings for explaining the modes for carrying out the invention, and the explanations thereof will not be repeated.

First Embodiment

In the embodiment, an example of an antenna beam scan module using a Rotman lens will be described.

FIG. 1 is a configuration diagram of an antenna beam scan module of the embodiment. The reference numeral 1 denotes the entirety of an antenna beam scan module using a Rotman lens antenna; 2, a Rotman lens antenna; 3, one-input multi-output switches; 4, variable amplifiers; 5, phase shifters; 6, relative phase detectors; 7, a beam scan controller; 8, transmission paths; and 9, a high-frequency signal terminal. The Rotman lens antenna 2 includes a Rotman lens 21 and antenna elements 22. The Rotman lens 21 has plural beam ports 24 and plural antenna ports 23. Each of the antenna elements 22 is connected to one antenna port 23 of the Rotman lens 21, and an output of each variable amplifier 4 that can perform magnitude modulation is connected to one beam port 24. One phase shifter 5 or one transmission path 8 is connected to an input of each variable amplifier 4. For the variable amplifiers 4 that are arranged in parallel, the phase shifters 5 and the transmission paths 8 are alternately arranged. The switches 3 are connected to the other terminals of the phase shifters 5 or the transmission paths 8, and transmission signals propagated from the high-frequency signal terminal 9 are selectively propagated to the Rotman lens antenna 2 by the switches 3.

When electric power is supplied to one of plural beam ports, a beam is output in a predetermined direction corresponding to the beam port using the Rotman lens antenna. Further, when electric power is supplied to two adjacent beam ports, beams are output in directions corresponding to the beam ports, and a beam propagated in the intermediate direction of the beams is formed by spatial combination. If there is a phase difference between two beams, the beams interfere with each other to negate each signal. Thus, the electric power of the combined beam in the intermediate direction corresponds to (1+COS (phase difference)). Accordingly, in order to realize spatial combination in which electric power can be maximized by overlapping two beams with each other, the phases of the two beams need to be in phase.

Figure 2:
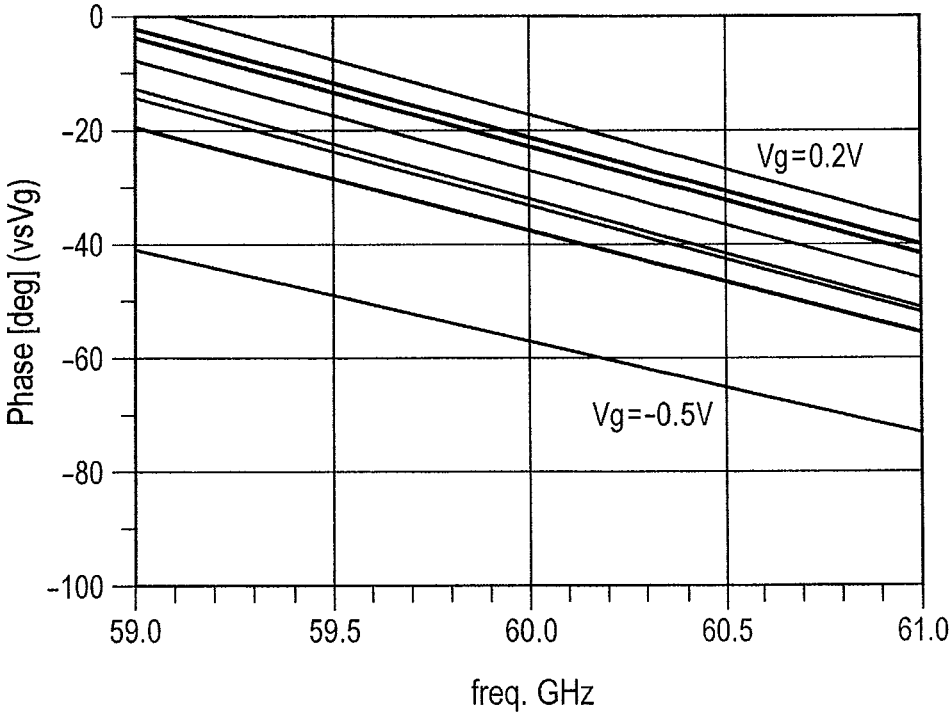
FIG. 2 is a diagram for showing a relation between gain control voltage and passing phases of variable amplifiers used in the antenna beam scan module.

When electric power is supplied to two adjacent beam ports of the Rotman lens antenna, the beam directions are shifted depending on the electric power ratio of two transmission signals as described in Japanese Patent Application Laid-Open Publication No. 2010-074781. However, as the transmission characteristics of the variable amplifiers 4, passing phases are fluctuated relative to gain control voltage (Vg) as shown in FIG. 2. Accordingly, if the control of the electric power ratio of two transmission signals is imbalanced, a phase difference occurs between the transmission signals input to the beam ports due to the different passing phases. In order to control the beams in predetermined directions, a beam scan control unit 10 of the beam scan controller 7 calculates the gain of each variable amplifier, a phase difference offset value, and route selection of the switches using a designated angle input from the outside. A switch selector 13 selects and connects one or two of the switches 3 that input the transmission signals into the variable amplifiers 4, and a PA gain control 11 performs gain settings for the transmission signals of the variable amplifiers 4 with the routes selected. If two switches 3 are selected and connected, a phase difference occurs due to the gain settings. Thus, a phase control 12 controls the phase shifters 5 to offset the phase difference. While preparing a variable amplifier gain (Vg)-passing phase (Phase) conversion table, the offset values of the phase shifters are calculated by predicting a difference in phases having passed through two variable amplifiers. The transmission paths 8 have intermediate phase components of the fluctuation range of the phases passing through the phase shifters 5. The phase variable range of each phase shifter 5 is designed in a range about twice the fluctuations of the phases passing through the variable amplifiers to offset the phase difference between two transmission signals.

Using distributors or couplers between the beam ports 24 of the Rotman lens antenna 2 and the variable amplifiers 4, transmission signals are partially extracted to be input to the relative phase detectors 6. The relative phase detectors 6 calculate a phase difference between a transmission signal generated through one of the phase shifters and those generated in adjacent routes. If transmission signals whose components are the same and whose magnitudes and phases are different are input to a phase detector configured using a mixer, for example, an I/Q mixer, two DC signals are generated due to the phase difference. These signals correspond to sin (phase difference) and cos (phase difference).

Figure 3:
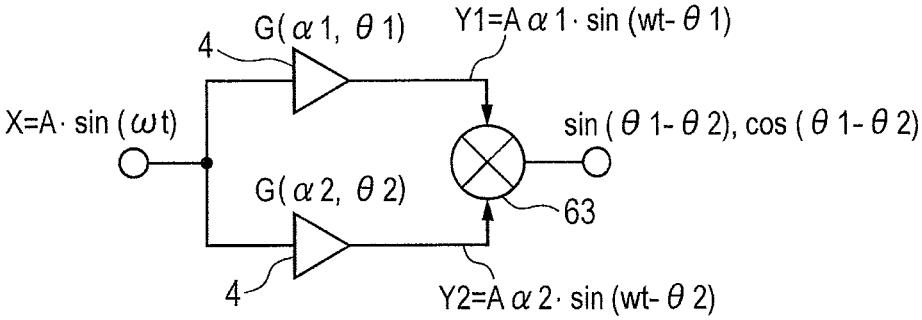
FIG. 3 is an equivalent circuit diagram for showing operations of a relative phase detector.

FIG. 3 is an equivalent circuit diagram for showing operations of a phase detector using an I/Q mixer 63. It is assumed that a transmission signal input to the antenna beam scan module is represented as X=A·sin(wt), and the transfer functions of the variable amplifiers 4 are represented as G(α1, θ1) and G(α2, θ2). In addition, it is assumed that the magnitude gains are represented as α1 and α2 and the phase delays are represented as θ1 and θ2. The output signals of the variable amplifiers 4 are shown below.

$$Y1=A\cdot\alpha1\cdot\sin(wt-\theta1)$$

$$Y2=A\cdot\alpha2\cdot\sin(wt-\theta2)$$

If the transmission signals Y1 and Y2 are mixed (multiplied) in the I/Q mixer, the following result can be obtained.

$$\begin{aligned}Y1\cdot Y2 &= A\cdot\alpha1\cdot\sin(wt-\theta1)\times A\cdot\alpha2\cdot\sin(wt-\theta2)\\ &= A^2\cdot\alpha1\alpha2\cdot\sin(wt-\theta1)\sin(wt-\theta2)\\ &= A^2\cdot\alpha1\alpha2\cdot1/2\{-\cos((wt-\theta1)+(wt-\theta2))+\\ &\quad\cos((wt-\theta1)-(wt-\theta2))\}\\ &= A^2\cdot\alpha1\alpha2\cdot1/2\{-\cos(2wt-(\theta1+\theta2))-\cos(\theta1-\theta2)\}\end{aligned}$$

$$DC\text{ component}=A^2\cdot\alpha1\alpha2\cdot1/2\cos(\theta1-\theta2)$$

$$\begin{aligned}Y1\cdot(Y2e^{\pi/2}) &= A\cdot\alpha1\cdot\sin(wt-\theta1)\times A\cdot\alpha2\cdot\sin(wt-\theta2+\pi/2)\\ &= A^2\cdot\alpha1\alpha2\cdot\sin(wt-\theta1)\sin(wt-\theta2+\pi/2)\\ &= A^2\cdot\alpha1\alpha2\cdot1/2\{-\cos((wt-\theta1)+(wt-\theta2))+\\ &\quad\cos((wt-\theta1)-(wt-\theta2+\pi/2))\}\\ &= A^2\cdot\alpha1\alpha2\cdot1/2\{-\cos(2wt-(\theta1+\theta2))-\\ &\quad\cos(\theta1-\theta2+\pi/2)\}\\ &= A^2\cdot\alpha1\alpha2\cdot1/2\{-\cos(2wt-(\theta1+\theta2))+\sin(\theta1-\theta2)\}\end{aligned}$$

$$DC\text{ component}=A^2\cdot\alpha1\alpha2\cdot1/2\sin(\theta1-\theta2)$$

The calculation of the ratio of the DC components results in sin(θ1−θ2)/cos θ(θ1−θ2)=tan(θ1−θ2) and the relative phase difference can be calculated. The relative phase amounts obtained by the relative phase detectors 6 are fed back to the beam scan controller 7 to be added to the phase offset values by accumulators 14, and the phase offset values of the phase shifters 5 are amended. Accordingly, the feedback control is performed so that the phases of the adjacent transmission signals are in phase.

The phase difference between the adjacent transmission signals is offset by feedback control at the relative phase detectors 6 in the embodiment. Thus, the phase control can be realized only by preparing the variable amplifier gain (Vg)-passing phase (Phase) conversion table, and an inspection of temperature characteristics relative to in-phase signals can be simplified.

If switches are used in distribution of electric power to be sorted into the beam ports of the Rotman lens antenna, it is possible to realize output ports that are high in reflectivity coefficient relative to line characteristic impedance when the switches are not connected, and transmission signals can be propagated to desired terminals without attenuation of the transmission signals in reverse proportion to the number of distributions.

The input impedance of each variable amplifier 4 is fluctuated due to magnitude control. If transmission signals input from the high-frequency signal terminal 9 are distributed using the distributors determined in accordance with the impedance ratios, the impedance ratios are changed due to matching fluctuation caused by the magnitude control of the variable amplifiers. Thus, it becomes difficult to control the magnitudes and phases of the transmission signals. Accordingly, using the switches 3 for distribution of electric power of the transmission signals, the number of variable amplifiers 4 that are functionally connected to the high-frequency signal terminal 9 is limited to up to 2 to suppress the fluctuation of the impedance, so that the phases can be sufficiently offset by the relative phase detectors 6.

Second Embodiment

Figure 4:
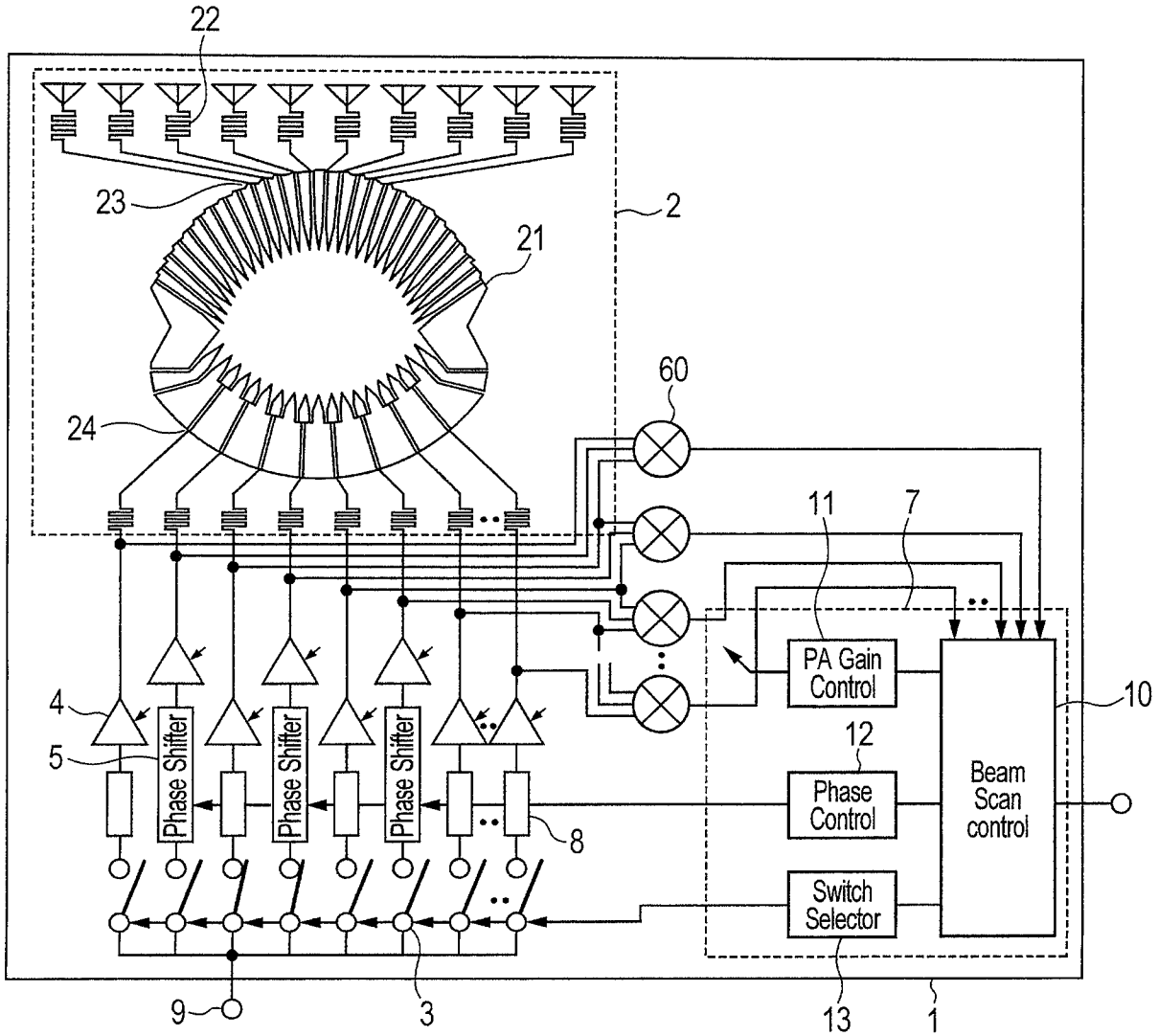
FIG. 4 is a configuration diagram of an antenna beam scan module according to a second embodiment of the present invention.

In the embodiment, an example of an antenna beam scan module that performs not only the relative phase difference offset, but also the magnitude offset will be described. FIG. 4 is a configuration diagram of an antenna beam scan module of a second embodiment. The reference numeral 1 denotes the entirety of an antenna beam scan module using a Rotman lens antenna; 2, a Rotman lens antenna; 3, one-input multi-output switches; 4, variable amplifiers; 5, phase shifters; 60, relative magnitude and phase detectors; 7, a beam scan controller; 8, transmission paths; and 9, a high-frequency signal terminal. In the antenna beam scan module 1 of FIG. 4, the constitutional elements having the same functions as those with the same reference numerals shown in FIG. 1 which have already been described will not be explained again.

Figure 5:
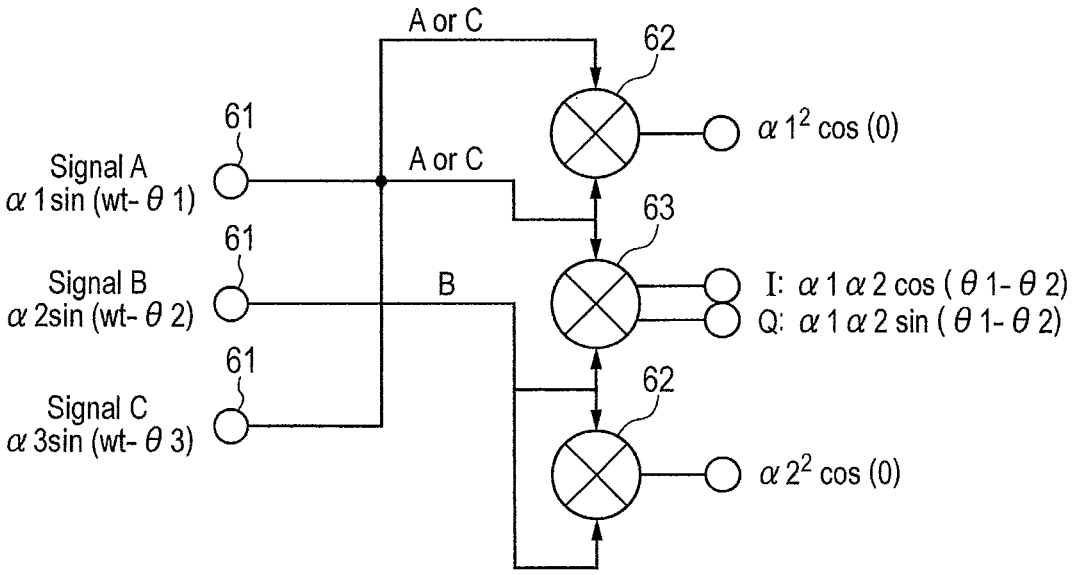
FIG. 5 is a circuit diagram of a relative magnitude and phase detector.

A circuit configuration of the relative magnitude and phase detector 60 is shown in FIG. 5. To the relative magnitude and phase detector, input are three transmission signals including a transmission signal having passed through the phase shifter 5 and those of adjacent beam ports. In FIG. 5, the reference numeral 61 denotes three input terminals for a signal A, a signal B, and a signal C; 62, single mixers; and 63, an I/Q mixer. The signal A and signal C of the input terminals 61 are connected to each other at the relative magnitude and phase detector. However, the routes of the transmission signals of the adjacent beam ports are selected by the switches 3, and thus the transmission signals are transmitted to one of them. The transmission signal having passed through the phase shifter 5 is input as the signal B. By mixing the same signals, one of the single mixers 62 can obtain magnitude informational of the transmission signal A ($\alpha 1 \sin(wt-\theta 1)$) or magnitude information $\alpha 3$ of the transmission signal C ($\alpha 3 \sin(wt-\theta 3)$), and the other can obtain magnitude information $\alpha 2$ of the transmission signal B ($\alpha 2 \sin(wt-\theta 2)$). The I/Q mixer 63 can obtain a DC signal to calculate the relative phases of two transmission signals. If the square root of the ratio of the magnitude information of $\alpha 1^2 \cos(0)$ to that of $\alpha 2^2 \cos(0)$ obtained by the single mixers 62 is calculated, the relative magnitude can be obtained, so that the relative magnitude and phase can be calculated from the transmission signals A, B, and C by combining the results of the relative phases at the I/Q mixer.

In the configuration of the second embodiment, the results of the calculation by the relative magnitude and phase detectors 60 are fed back to the beam scan control unit 10 of the beam scan controller 7 as two pieces of error information of phase information and magnitude information. Using the two pieces of error information, the control amounts of the variable amplifiers 4 and the phase shifters 5 can be calculated again. Using the error signal of the phase information, the phase offset value of each phase shifter 5 is amended through the phase control 12. In addition, using the error signal of the magnitude information, the gain of each variable amplifier 4 is amended through the PA gain control 11. Accordingly, the two error signals are obtained by the configuration of the second embodiment to control the magnitude and phase, so that more-accurate beam angle scanning by the transmission beams generated from two beam ports can be realized.

Third Embodiment

Figure 6:
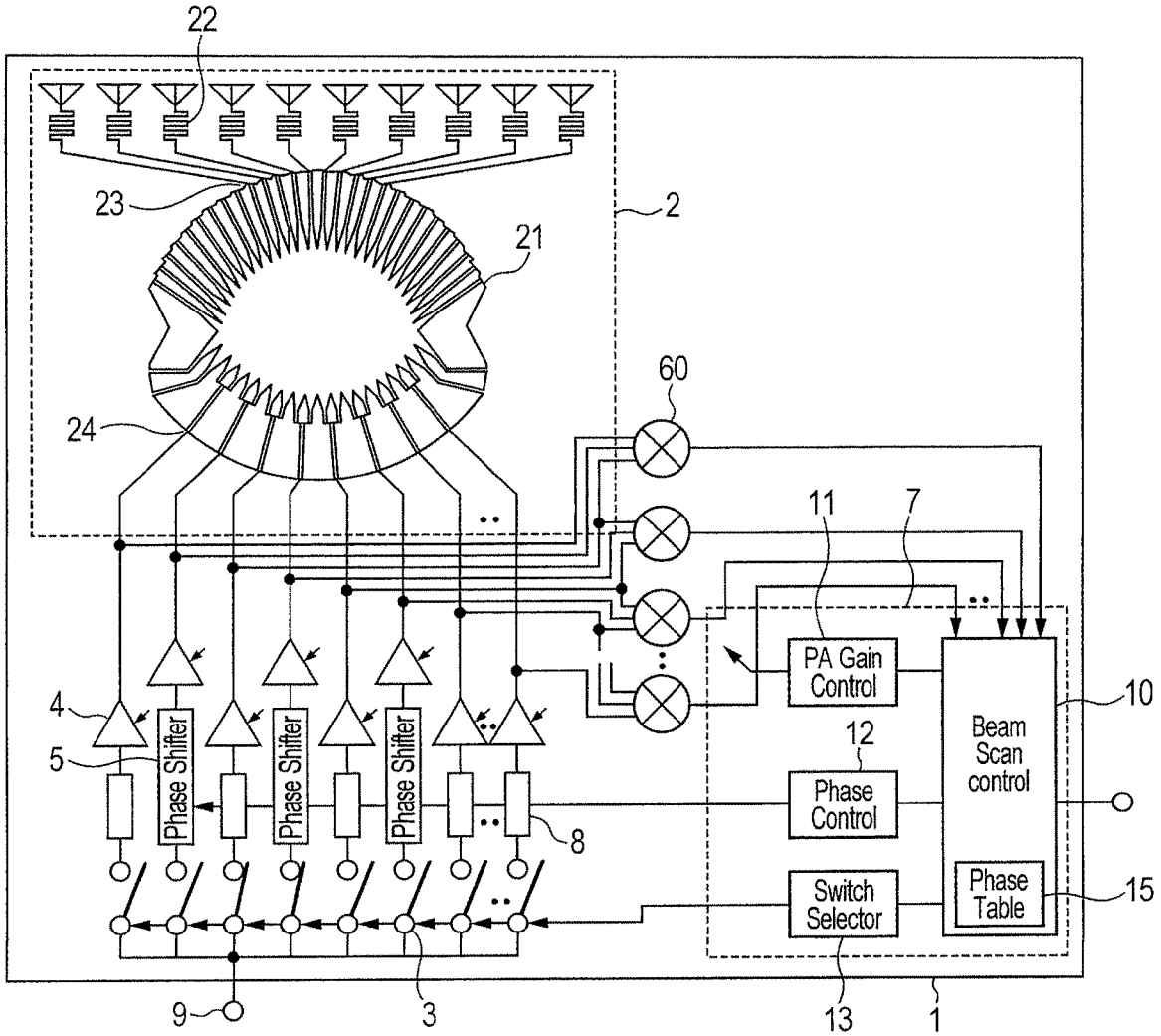
FIG. 6 is a configuration diagram of an antenna beam scan module according to a third embodiment of the present invention.

In the embodiment, an example of an antenna beam scan module that performs the phase offset of beam ports of a Rotman lens antenna will be described. FIG. 6 is a configuration diagram of an antenna beam scan module of a third embodiment. The reference numeral 1 denotes the entirety of an antenna beam scan module using a Rotman lens antenna; 2, a Rotman lens antenna without in-phase offset between inputs of beam ports; 3, one-input multi-output switches; 4, variable amplifiers; 5, phase shifters; 60, relative magnitude and phase detectors; 7, a beam scan controller; 8, transmission paths; and 9, a high-frequency signal terminal. In the antenna beam scan module 1 of FIG. 6, the constitutional elements having the same functions as those with the same reference numerals shown in FIG. 1 and FIG. 4 which have already been described will not be explained again. In the case where a transmission signal is supplied to only one beam port of the Rotman lens antenna to perform beam scanning, operations can be performed even if there is no in-phase correlation between beam ports. However, in the case where beam spatial combination is performed using two beam ports, it is necessary to adjust the phases of the transmission signals to be supplied at the point input to the Rotman lens. In a shipping inspection of an antenna beam scan module, relative phase differences between the beam ports are measured to prepare a table (Phase Table) 15. The result is recorded in the beam scan controller 7 to be reflected on error information of the relative magnitude and phase detectors 60. Specifically, the phase error information of the relative magnitude and phase detectors is combined with the values of the relative phase differences in the table, so that antenna beam scanning control can be performed even by the antenna 2 without relative in-phase properties of the beam ports. Accordingly, it is possible to be widely adapted to various antennas without the necessity of complicating the antenna beam scan module.

Fourth Embodiment

Figure 7:
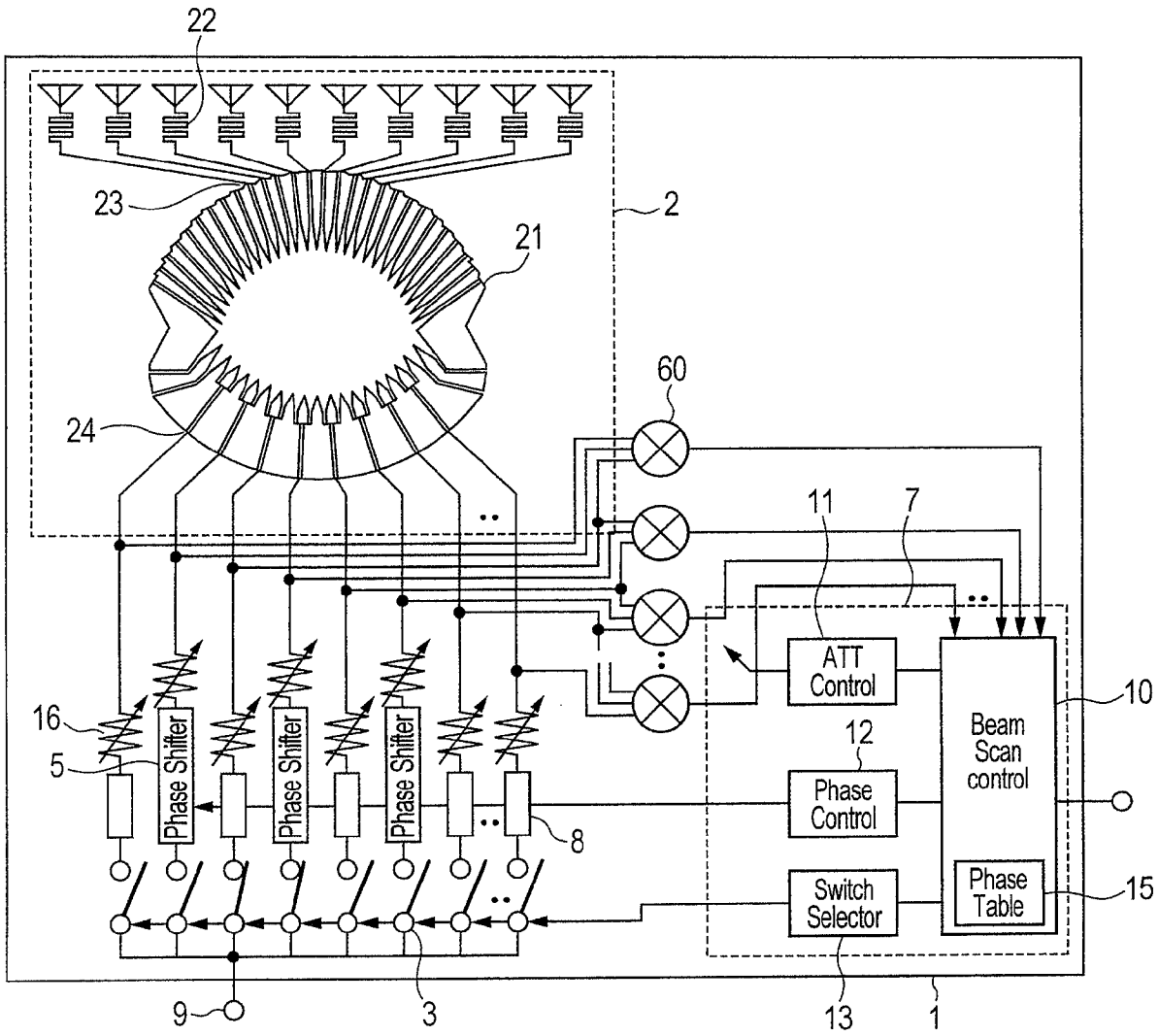
FIG. 7 is a configuration diagram of an antenna beam scan module according to a fourth embodiment of the present invention.

In the embodiment, an example of an antenna beam scan module in which a variable attenuator is used for a constitutional element connected to beam ports of a Rotman lens antenna. FIG. 7 is a configuration diagram of an antenna beam scan module of a fourth embodiment. The reference numeral 1 denotes the entirety of an antenna beam scan module using a Rotman lens antenna; 2, a Rotman lens antenna without in-phase offset between inputs of beam ports; 3, one-input multi-output switches; 16, a variable attenuator; 5, phase shifters; 60, relative magnitude and phase detectors; 7, a beam scan controller; 8, transmission paths; and 9, a high-frequency signal terminal. In the antenna beam scan module 1 of FIG. 7, the constitutional elements having the same functions as those with the same reference numerals shown in FIG. 1 to FIG. 6 which have already been described will not be explained again. In the case where a transmission signal obtained from the high-frequency signal terminal 9 is sufficiently large, the antenna beam scan module 1 can control beam scanning using variable attenuators 16 in place of the variable amplifiers 4. In the control of the beam directions using two beam ports, the relative ratio of transmission electric power to be supplied to two beam ports is used. If the relative ratio of two transmission signals can be controlled by the variable attenuators 16, the beam scanning can be performed without amplification. Further, since no amplifiers are provided in the antenna beam scan module, the amount of phase fluctuations in the magnitude control can be suppressed, and changes in temperature characteristics due to heat are small. Further, since fluctuations in impedance due to phase control are small, it is conceivable that fluctuations in magnitude and phase due to distribution of electric power by the switches can be suppressed.

Fifth Embodiment

Figure 8:
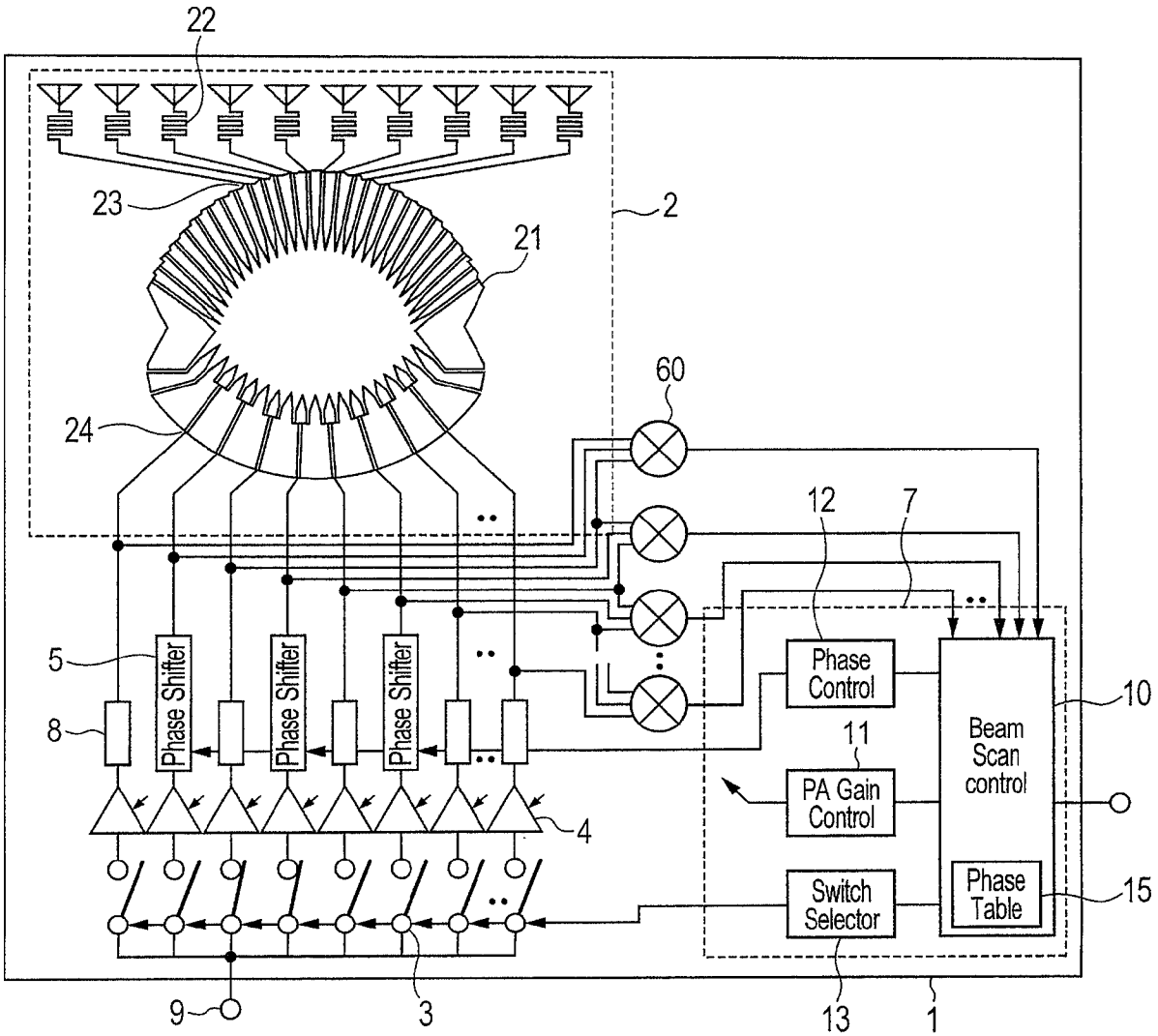
FIG. 8 is a configuration diagram of an antenna beam scan module according to a fifth embodiment of the present invention.

In the embodiment, a second example of an antenna beam scan module in which variable amplifiers are used for beam ports of a Rotman lens antenna will be described. FIG. 8 is a configuration diagram of an antenna beam scan module of a fifth embodiment. The reference numeral 1 denotes the entirety of an antenna beam scan module using a Rotman lens antenna; 2, a Rotman lens antenna without in-phase offset between inputs of beam ports; 3, one-input multi-output switches; 4, variable amplifiers; 5, phase shifters; 60, relative magnitude and phase detectors; 7, a beam scan controller; 8, transmission paths; and 9, a high-frequency signal terminal. In the antenna beam scan module 1 of FIG. 8, the constitutional elements having the same functions as those with the same reference numerals shown in FIG. 1 to FIG. 7 which have already been described will not be explained again. FIG. 8 is different from FIG. 3 of the second embodiment in the arrangement of the variable amplifiers 4 and the phase shifters 5. In the embodiment, the phase shifters 5 and the transmission paths 8 are arranged after the variable amplifiers 4. The output impedance of each variable amplifier is fluctuated by the magnitude control, and thus a transmission signal is largely fluctuated due to impedance matching with the antenna 2. A matching improvement effect is expected by arranging the phase shifters 5 after the variable amplifiers 4 to serve as direction couplers.

Sixth Embodiment

In the embodiment, an example of an antenna beam scan module for receiver using a Rotman lens will be described.

Figure 9:
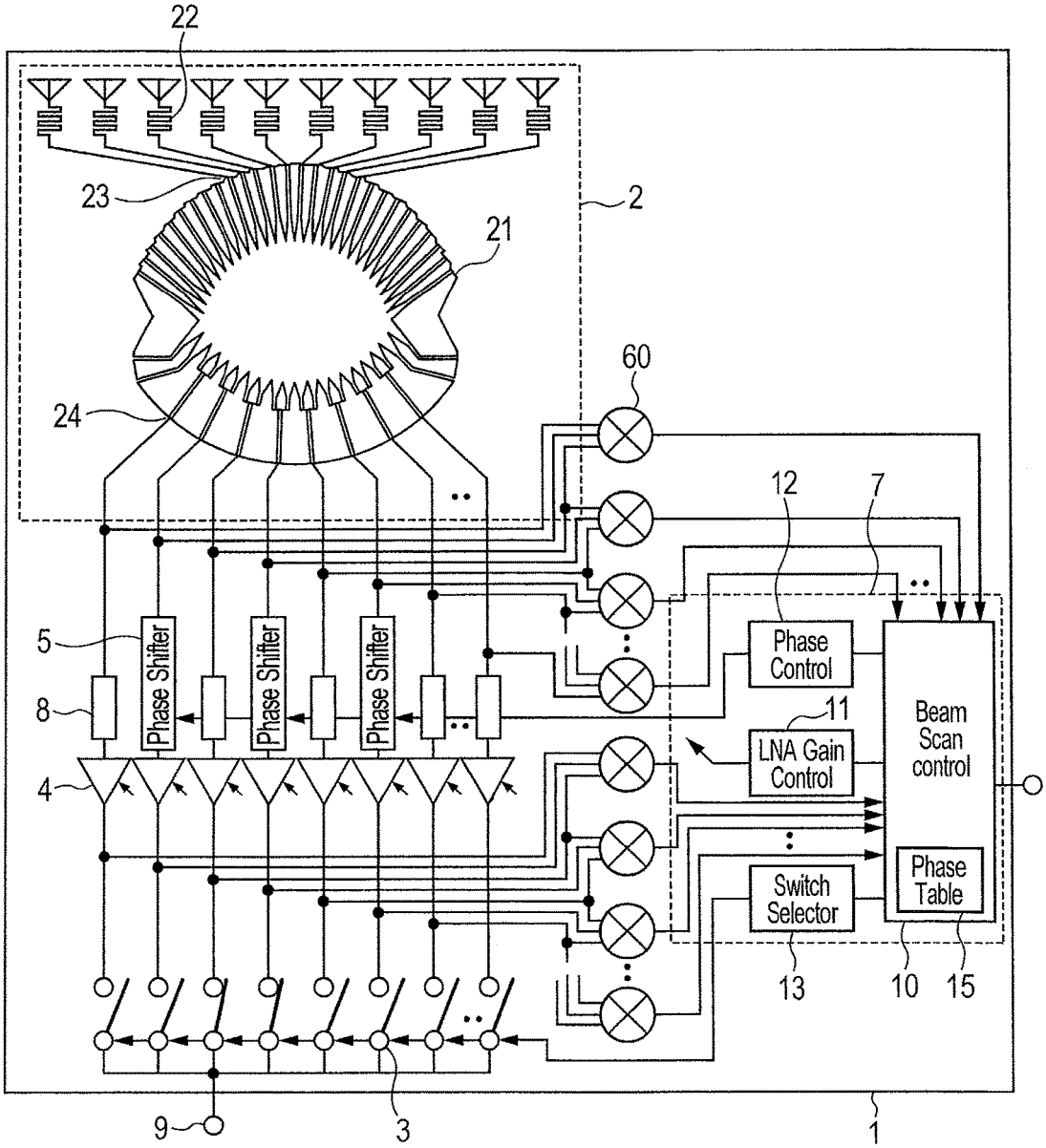
FIG. 9 is a configuration diagram of an antenna beam scan module according to a sixth embodiment of the present invention.

FIG. 9 is a configuration diagram of an antenna beam scan module for receiver in the embodiment. The reference numeral 1 denotes the entirety of an antenna beam scan module using a Rotman lens antenna; 2, a Rotman lens antenna; 3, one-input multi-output switches; 4, variable amplifiers; 5, phase shifters; 60, relative magnitude and phase detectors; 7, a beam scan controller; 8, transmission paths; and 9, a high-frequency signal terminal. The Rotman lens antenna 2 includes a Rotman lens 21 and antenna elements 22. The Rotman lens 21 includes plural beam ports 24 and plural antenna ports 23. Each antenna element 22 is connected to one antenna port 23 of the Rotman lens antenna 2, and each of the phase shifters 5 or the transmission paths 8 is connected to one beam port 24. Reception signals having passed through the phase shifters 5 or the transmission paths 8 are input to the variable amplifiers 4, and then input to the switches 3. The electric power of the reception signal whose route has been selected by the switches 3 is combined with another to be output to the high-frequency signal terminal 9. The relative magnitude and phase detectors 60 calculate the relative degrees of the signals at output units of the antenna 2 and at output units of the variable amplifiers 4. For example, it is assumed that the phases of output signals of adjacent beam ports of the Rotman lens antenna 2 are represented as Ø1 and Ø2, and the phases of adjacent output signals of the corresponding variable amplifiers 4 are represented as Ø1' and Ø2'. Preceding and subsequent relative magnitude and phase detectors 60 detect Ø1-Ø2 and Ø1'-Ø2'. The constitutional elements having the same functions as those with the same reference numerals shown in FIG. 1 to FIG. 8 which have already been described will not be explained again.

In the antenna beam scan module for receiver 1, the phase information Ø1 and Ø2 of reception signals output to the beam ports 24 of the Rotman lens antenna 2 are not always the same. Thus, fluctuations {(Ø1-Ø2)-(Ø1'-Ø2')} of the relative phase differences are observed before and after the routes passing through the variable amplifiers 4 and the phase shifters 5, or the transmission paths 8, and are fed back to the phase shifters 5 so that the phase differences Ø1-Ø2 and Ø1'-Ø2' before and after the routes become the same. In the phase difference offset between the beam ports of the Rotman lens antenna 2, the phase difference is reflected on an error signal in a phase table 15 of the beam scan controller 7 to generate an offset signal. According to the embodiment, fluctuations in the relative phase difference between adjacent signals caused by the magnitude control of the variable amplifiers can be offset. Accordingly, it is possible to realize an antenna beam scan module for receiver enabling scanning at non-step antenna beam angles by using the configuration of the embodiment shown in FIG. 9.

Figure 10:
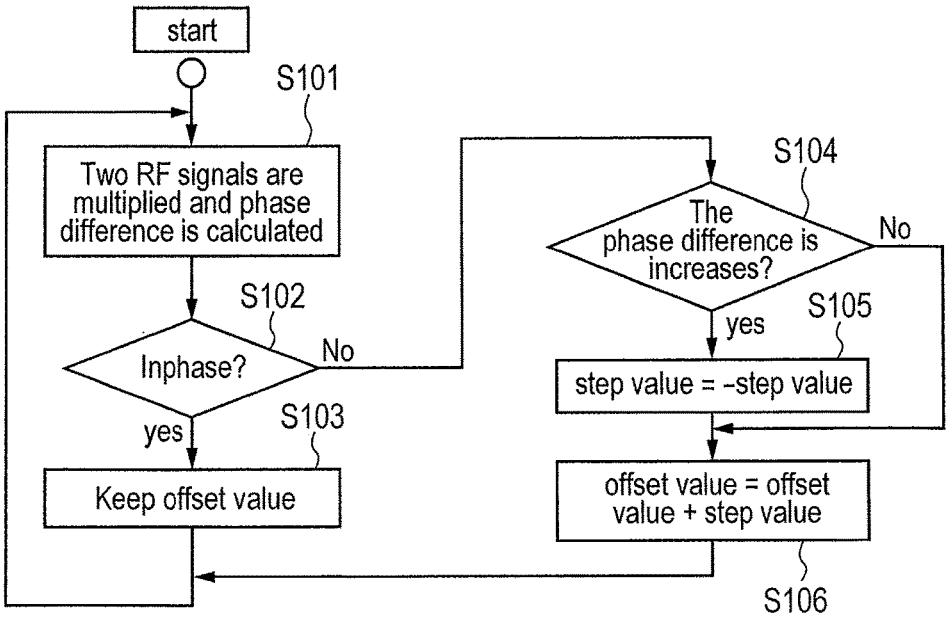
FIG. 10 is a flowchart for controlling the offset values of phase shifters.

FIG. 10 is a flowchart for amending the offset values of the phase shifters of the beam scan controller 7 using the error signals obtained from the relative phase detectors 6 or the relative magnitude and phase detectors 60. The error signals obtained from the relative phase detectors 6 or the relative magnitude and phase detectors 61 on which the phase table of the antenna beam scan module 1 has been reflected monitor an increase or decrease in phase difference at the beam scan controller 7 (S101). In the case where a phase difference occurs between the adjacent routes (S102), a step value is added to the offset value of each phase shifter for amendment (S106). In the case where the phase difference is increased before and after sampling of detection of the phase difference (S104), the sign of the step value is inversed to be added to the offset value, so that the phase difference is controlled to be minimized (S105). The step value is set at the error signal or smaller. In the case where the inversion of the sign of the step value is repeated, for example, the step value is decreased to be half the error signal, and fluctuations of the offset value are suppressed. Accordingly, phase fluctuations by the phase offset feedback control can be reduced.

Seventh Embodiment

Figure 11:
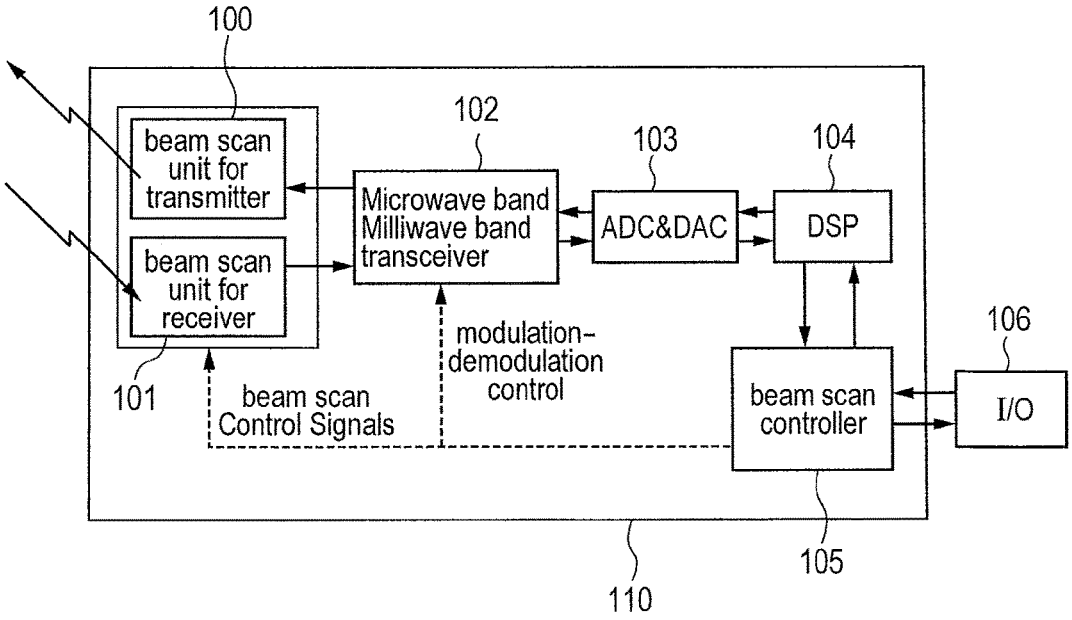
FIG. 11 is a configuration diagram of a communication apparatus using the antenna beam scan module of the present invention.
Figure 12:
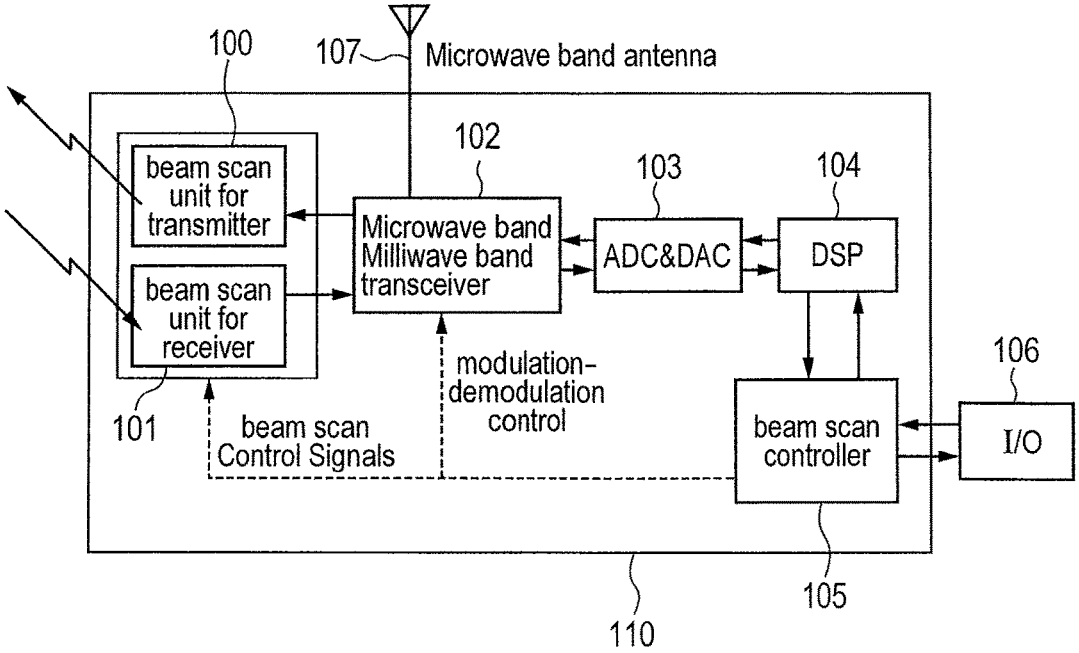
FIG. 12 is another configuration diagram of a communication apparatus using the antenna beam scan module of the present invention.

In the embodiment, an example of a communication apparatus using an antenna beam scan module will be described. The embodiment of the communication apparatus using the antenna beam scan module is shown in FIG. 11. The reference numeral 100 denotes an antenna beam scan module for transmitter; 101, an antenna beam scan module for receiver; 102, a microwave band/milliwave band transceiver; 103, an analog/digital conversion circuit; 104, a signal processing circuit; 105, a beam scan controller; 106, an input/output terminal; and 110, the entirety of the communication apparatus. In order to establish wireless communications, transmission data is generated in accordance with communication protocols by the signal processing circuit 104 through the beam scan controller 105. The microwave band/milliwave band transceiver 102 performs modulation on the basis of the transmission data, and transmits microwave band/milliwave band signals to the antenna beam scan module for transmitter. The antenna beam scan modules 100 and 101 select the beam ports of the Rotman lens and perform relative magnitude and phase control in accordance with commands from the beam scan controller. In the selection of the beam ports, the switches 3 in the beam scan module are switched and amplification control for the variable amplifiers 4 is performed. After the transmission data is transmitted at the time of transmission, a signal from a target communication apparatus is captured. Thus, after radios waves are intercepted from the antenna beam scan module for receiver 101 and demodulated by the transceiver 102, the presence or absence of communication signals, evaluation of signal levels, the probability of a data error bar are inspected by the signal processing circuit 104, and the results are transmitted to the beam scan controller 105. If there is no communication data, the commands from the beam scan controller are updated and the scanning is sequentially performed by the antenna beam scan module to search for communication signals. Milliwave band signals are high in straightness and large in propagation attenuation. Thus, if unknown communication lines are established by scanning using high-gain narrow-angle antenna beams, there is a possibility of having a trouble in scanning and a loss of communication signals. Thus, a microwave-band transmission/reception antenna 107 is provided for the microwave band/milliwave band transceiver 102 as shown in FIG. 12 to be used as an auxiliary communication device up to establishment of milliwave-band communications while having wireless communication mechanisms such as Bluetooth (registered trademark) and ZigBee (registered trademark) represented by IEEE802.15, and the establishment of communications between communication apparatuses is assisted. Accordingly, it is conceivable that a loss of communication signals can be reduced. Further, if unnecessary scanning using milliwave band signals can be reduced, the milliwave band transceiver that is poor in efficiency of electric power can be stopped without being always operated, and thus electric power can be saved.

Figure 13:
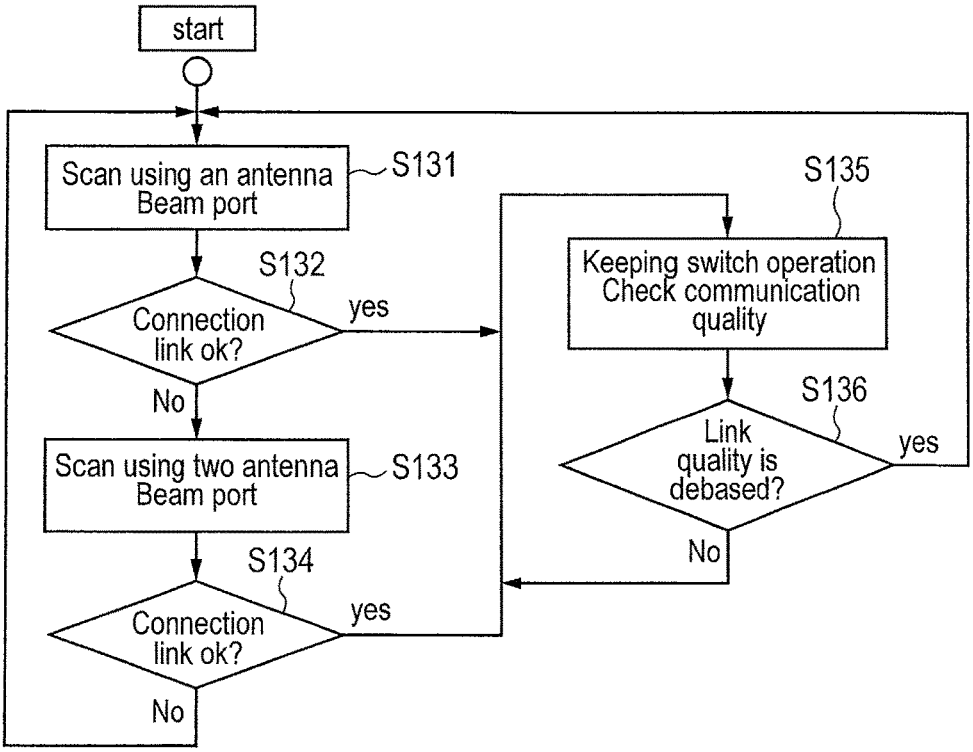
FIG. 13 is a flowchart of antenna beam scanning by the communication apparatus.

FIG. 13 is a flowchart of the beam scan controller that operates the antenna beam scan module. The beam scan controller 105 performs antenna beam scanning using one beam port (S131), and determines whether to be able to establish communications on the basis of the results of evaluating the presence of communication signals, the presence or absence of signal levels required for demodulation, and error rates by the signal processing circuit 104 (S132). If signal levels enough to establish communications have been reached, control signals for the antenna beam scan module are stored to start communications between communication apparatuses. During establishment of communications, the beam scan controller 105 sequentially evaluates the results of evaluation of the communication quality (S135), and scanning is started again on the basis of the presence or absence of deterioration of the communication quality and communication data (S136). In the case where the deterioration of a signal can be observed with one beam port, it can be expected that the S/N ratio of the signal is deteriorated. In this case, the beam scan controller 105 switches to beam scanning for spatial combination with two beam ports to start scanning by beam forming (S133). In the case where improvement of error rates can be expected, communications are started (established) (S134). However, in the case of the communication quality that does not meet the requirement of establishment of communications, the flow is returned to the start to perform the steps again to search for a new communication path.

What is claimed is:

1. An antenna beam scan module comprising:

a Rotman lens that has a plurality of beam ports and a plurality of antenna ports and distributes and combines electric power of signals input and output to the antenna ports;

a plurality of antenna elements that input and output radio waves to the antenna ports;

a plurality of variable amplifiers that modulate magnitudes of the signals input to the beam ports;

a plurality of relative phase detectors that detect a plurality of relative phase differences between the signals input to the adjacent beam ports;

a plurality of phase shifters that offset the relative phase differences between the signals supplied to the adjacent beam ports on the basis of the relative phase differences detected by the relative phase detectors; and a plurality of switches that select routes of the signals supplied to the beam ports through the variable amplifiers, wherein the phase shifters are arranged on alternate routes through which the signals are supplied to the plurality of beam ports.

2. The antenna beam scan module according to claim 1, further comprising:

a beam scan controller configured to independently control the switches and the variable amplifiers based on input antenna angle information.

3. The antenna beam scan module according to claim 2, wherein a table of data related to phase fluctuations caused in accordance with the magnitude controlled by the variable amplifiers is stored in the beam scan controller to control the offset values of the phase shifters on the basis of the table, and the offset values are amended using the relative phase differences between the signals that are detected by the relative phase detectors and are input to the adjacent beam ports.

4. The antenna beam scan module according to claim 2, wherein the relative phase detectors that detect the relative phase differences between the signals input to the adjacent beam ports are on the output side of the variable amplifiers, and the beam scan controller is configured to output a plurality of control signals for adjusting the relative phase differences between the signals of the adjacent beam ports to the phase shifters on the basis of the relative phase differences detected by the relative phase detectors.

5. The antenna beam scan module according to claim 4, wherein the relative phase detectors detect a plurality of magnitude differences in addition to the relative phase differences between the signals input to the adjacent beam ports, and the beam scan controller is configured to output the control signals for adjusting the relative magnitude differences between the signals of the adjacent beam ports to the variable amplifiers on the basis of the detected magnitude differences.

6. The antenna beam scan module according to claim 5, wherein the relative phase detectors that detect the relative phase differences between the signals input to the beam ports are configured using one I/Q mixer and two single mixers, the respective relative phase difference between two signals is detected on the basis of the magnitude ratio of a signal I: cos (phase difference) to a signal Q: sin (phase difference) obtained by mixing the adjacent signals with the I/Q mixer, and the magnitudes of the signals are calculated by the single mixers to obtain the magnitude ratio of two signals.

7. The antenna beam scan module according to claim 2, wherein the phase shifters are provided on the output side of the variable amplifiers, the relative phase detectors detect the relative phase differences between the signals input to the adjacent beam ports on the output side of the phase shifters, and the beam scan controller is configured to output the control signals for adjusting the relative phase differences between the signals of the adjacent beam ports to the phase shifters on the basis of the relative phase differences detected by the relative phase detectors.

8. The antenna beam scan module according to claim 2, wherein the beam scan controller is configured to store propagation phase data of the beam ports of the Rotman lens to amend the phase differences between the signals obtained by the relative phase detectors, and the offset values of the phase shifters are adjusted.

9. The antenna beam scan module according to claim 1, wherein, on respective routes of the signals supplied to the beam ports for which no phase shifters are arranged, there is provided a transmission path having intermediate phase components in a range of fluctuations in passing phases of the phase shifters.

10. The antenna beam scan module according to claim 1, wherein the relative phase detectors that detect the relative phase differences between the signals input to the beam ports are configured using I/Q mixers and the respective relative phase difference between two signals is detected on the basis of the magnitude ratio of a signal I: cos (phase difference) to a signal Q: sin (phase difference) obtained by mixing adjacent signals.

11. An antenna beam scan module comprising:

a Rotman lens that has a plurality of beam ports and a plurality of antenna ports and distributes and combines electric power of signals input and output to the antenna ports;

a plurality of antenna elements that input and output radio waves to the antenna ports;

a plurality of variable amplifiers that modulate magnitudes of the signals supplied from the beam ports;

a plurality of relative phase detectors that are arranged before and after the variable amplifiers to detect fluctuations in relative phase differences between the adjacent signals before and after the variable amplifiers;

a plurality of phase shifters that offset the fluctuations in relative phase differences between the adjacent signals caused by the magnitude control on the basis of the fluctuations in relative phase differences detected by the relative phase detectors; and a plurality of switches that select routes of the signals supplied from the beam ports through the variable amplifiers, wherein the phase shifters are arranged on alternate routes through which the signals are supplied from the plurality of beam ports.

12. A communication apparatus using the antenna beam scan module according to claim 1.

13. The communication apparatus according to claim 12 comprising:

an antenna beam scan controller that is configured to control the antenna beam scan module;

a microwave band/milliwave band transceiver that modulates or demodulates RF signals input and output from the antenna beam scan module;

an analog/digital converter that converts an analog signal and a digital signal in transmission and reception of signals to/from the transceiver;

a signal processing circuit that processes digitalized communication signals; and an input/output terminal through which an external digital device is connected, wherein the antenna beam scan controller is configured to control antenna beam scanning of the antenna beam scan module based on an evaluation result of communication quality obtained from the signal processing circuit.

14. The communication apparatus according to claim 13, wherein a microwave-band transmission/reception antenna is provided for the microwave band/milliwave band transceiver.

* * * * *